US005195884A

United States Patent [19]

Schwartz et al.

[11] Patent Number: 5,195,884

[45] Date of Patent: Mar. 23, 1993

[54] LOW $NO_x$ FORMATION BURNER APPARATUS AND METHODS

[75] Inventors: Robert E. Schwartz, Tulsa; Samuel O. Napier, Sapulpa; Andrew P. Jones, Bixby; Roger K. Noble, Tulsa, all of Okla.

[73] Assignee: John Zink Company, A Division of Koch Engineering Company, Inc., Tulsa, Okla.

[21] Appl. No.: 858,663

[22] Filed: Mar. 27, 1992

[51] Int. Cl.[5] ..... F23C 5/00

[52] U.S. Cl. ..... 431/8; 431/116; 431/181

[58] Field of Search ..... 431/9, 174, 181, 187, 431/116, 8, 115

[56] References Cited

U.S. PATENT DOCUMENTS

| | | | |
|---|---|---|---|
| 4,277,942 | 7/1981 | Egnell et al. | 60/517 |
| 4,395,223 | 7/1983 | Okigami et al. | 431/10 |
| 4,505,666 | 3/1985 | Martin et al. | 431/175 |
| 4,575,332 | 3/1986 | Oppenberg et al. | 431/9 |
| 4,708,638 | 11/1987 | Brazier et al. | 431/116 |
| 5,044,932 | 9/1991 | Martin et al. | 431/116 |
| 5,073,105 | 12/1991 | Martin et al. | 431/116 |
| 5,098,282 | 3/1992 | Schwartz et al. | 431/9 |

FOREIGN PATENT DOCUMENTS

WO90/04740 5/1990 PCT Int'l Appl. .

*Primary Examiner*—Larry Jones

*Attorney, Agent, or Firm*—Laney, Dougherty, Hessin & Beavers

[57] ABSTRACT

Improved low $NO_x$ formation gas burner apparatus and methods of burning fuel are provided. The burner apparatus includes a refractory burner tile having a base portion and a wall portion, the wall portion extending into the furnace, surrounding a central area of the base portion and having exterior sides which are slanted. Means are attached to the burner tile for mixing a portion of the fuel gas with the air and discharging the resulting mixture into a primary burning zone in the furnace from within the space defined by the wall portion of the burner tile. At least one secondary fuel gas nozzle means positioned for discharging the remaining portion of the fuel gas adjacent to an external slanted side of the wall portion whereby the fuel gas mixes with flue gases and air in the furnace and burns in a secondary burning zone therein.

21 Claims, 2 Drawing Sheets

LOW $NO_x$ FORMATION BURNER APPARATUS AND METHODS

BACKGROUND OF THE INVENTION

1. Field of the Invention

The present invention relates to low $NO_x$ formation burner apparatus and methods of burning fuel gas—air mixtures whereby flue gases having low $NO_x$ content are produced.

2. Description of the Prior Art

The environmental emission standards imposed by governmental authorities are continuously becoming more stringent. Such standards limit the quantities of gaseous pollutants such as oxides of nitrogen ($NO_x$) and carbon monoxide which can be emitted into the atmosphere. As a result of the standards, improved burner designs have been developed which lower the production of $NO_x$ and other polluting gases. For example, methods and apparatus wherein fuel is burned in less than a stoichiometric concentration of oxygen to intentionally produce a reducing environment of CO and $H_2$ have been proposed. This concept has been utilized in staged air burner apparatus wherein the fuel is burned in a deficiency of air in a first zone producing a reducing environment that suppresses $NO_x$ formation, and the remaining portion of air is introduced into a second zone.

Methods and apparatus have also been developed wherein all of the air and some of the fuel is burned in a first zone and the remaining fuel is burned in a second zone. In this staged fuel approach, an excess of air in the first zone acts as a diluent which lowers the temperature of the burning gases and thereby reduces the formation of $NO_x$. Other methods and apparatus have been developed wherein flue gases are combined with fuel gas—air mixtures to dilute the mixtures and lower their combustion temperatures and the formation of $NO_x$.

While the prior art methods and burner apparatus for producing flue gases having low $NO_x$ contents have achieved varying degrees of success, there still remains a need for improvement in gas burner apparatus and methods of burning fuel gas whereby simple economical burner apparatus is utilized and low $NO_x$ content flue gases are produced.

SUMMARY OF THE INVENTION

By the present invention, the above mentioned needs for improved gas burner apparatus and methods of burning fuel-air mixtures are met. That is, the present invention provides improved gas burner apparatus and methods for discharging mixtures of fuel and air into furnaces wherein the mixtures are burned and flue gases having low $NO_x$ content are formed therefrom.

An improved low $NO_x$ formation burner apparatus of this invention is basically comprised of a refractory burner tile attached to a furnace having a base portion and a wall portion. The wall portion of the burner tile extends into the furnace and surrounds a central area of the base portion, and the exterior sides of the wall portion are slanted towards the central area of the base portion. Means are attached to the burner apparatus for continuously mixing a portion of the fuel gas utilized with substantially all of the air utilized and discharging the resulting mixture into a primary burning zone in the furnace from within the space defined by the central area of the base portion and the interior of the wall portion of the burner tile. At least one secondary fuel gas nozzle means is positioned outside of the wall portion of the burner tile for discharging the remaining portion of the fuel gas adjacent to an external slanted side of the wall portion. The secondary fuel gas readily mixes with flue gases in the furnace and burns in a secondary burning zone therein.

By the improved methods of the invention, a mixture of fuel gas and air is discharged into a furnace wherein the mixture is burned and flue gases having low $NO_x$ content are formed therefrom. The methods basically comprise the steps of mixing a portion of the fuel gas with substantially all of the air to form a primary fuel gas—air mixture, and discharging the primary fuel gas—air mixture into a primary burning zone in the furnace from at least one location surrounded by a wall portion of a refractory burner tile which extends into the furnace and has exterior sides which are slanted towards the discharge location. The remaining portion of the fuel gas is discharged from at least one location outside of the wall portion adjacent to an exterior slanted side of the wall portion whereby the fuel gas readily mixes with flue gases and remaining air in the furnace and is burned in a secondary burning zone therein.

It is, therefore, a general object of the present invention to provide improved low $NO_x$ formation burner apparatus and methods.

A further object of the present invention is the provision of relatively simple and economical burner apparatus for carrying out the methods of the present invention whereby low $NO_x$ content flue gases are produced.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
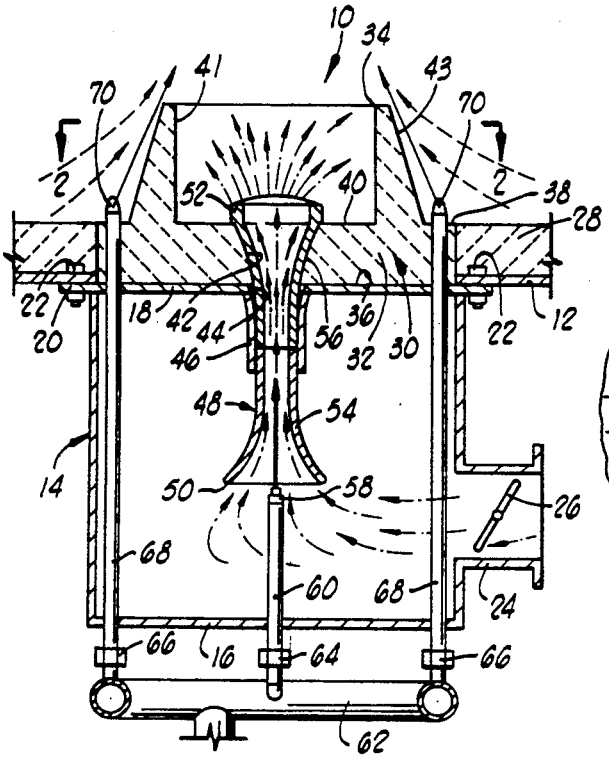
FIG. 1 is a side cross-sectional view of one form of the burner apparatus of the present invention attached to a furnace wall.
Figure 2:
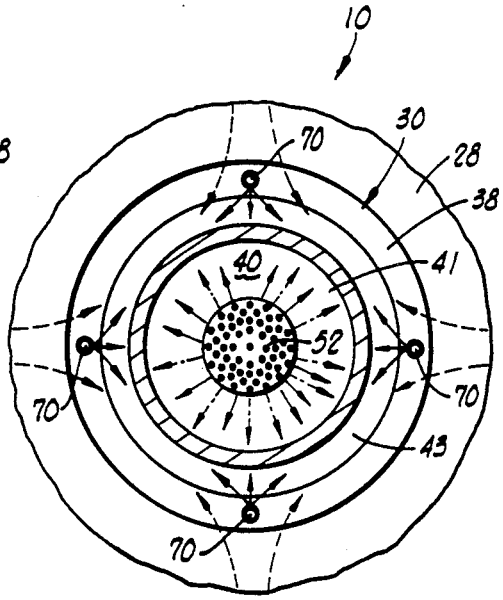
FIG. 2 is a cross-sectional view taken along line 2—2 of FIG. 1.

Referring now to the drawings, and particularly to FIGS. 1 and 2, a low $NO_x$ formation burner apparatus of the present invention is illustrated and generally designated by the numeral 10. The burner apparatus 10 is sealingly attached to the bottom wall 12 of a furnace over an opening therein. While gas burner apparatus are commonly mounted vertically to the bottom wall of a furnace and fired upwardly as shown in the drawings, it is to be understood that the burner apparatus of the present invention can also be mounted horizontally or it can be mounted vertically and fired downwardly.

The burner apparatus 10 is comprised of a housing 14 having a closed exterior end 16 and a substantially closed interior end 18. The housing 14 is attached to the furnace wall 12 by means of a flange 20 attached thereto and a plurality of bolts 22 which extend through complimentary openings in the flange 20 and the wall 12 A combustion air inlet connection 24 is attached to the housing 14, and a conventional air flow rate regulating damper 26 is connected to and disposed within the air inlet connection 24.

The furnace wall 12 includes an internal layer of insulating material 28 attached thereto, and a burner tile 30 formed of flame and heat resistant refractory material is attached to the interior end 18 of the housing 14. The burner tile 30 includes a base portion 32 and a wall portion 34. The exterior side 36 of the base portion 32 is positioned adjacent the end 18 of the housing 14, and the interior side 38 of the base portion 32 faces the interior of the furnace to which the burner apparatus 10 is attached. The wall portion 34 of the burner tile 30 extends into the furnace and surrounds a central area 40 of the side 38 of the base portion 32. The wall portion 34 includes internal sides 41 and external sides 43, and as shown in FIG. 1, the external sides 43 are slanted towards the interior of the wall portion 34. The furnace wall 12 and insulating material 28 along with other furnace walls and insulating material (not shown) define the furnace within which the fuel gas and air discharged by the burner apparatus 10 are burned as will be described further hereinbelow.

The burner tile 30 has a central opening 42 formed in the base portion 32 thereof, and the end 18 of the housing 14 includes an opening 44 which is complimentary to the opening 42. Attached within the housing 14 over the opening 44 in the end 18 thereof is an internally threaded tubular fitting 46. Connected within the fitting 46 is a venturi aspirator tube generally designated by the numeral 48 having a fuel gas and air inlet 50 at one end positioned within the interior of the housing 14 and a discharge nozzle 52 at the other end positioned within the space defined by the central area 40 of the base portion 32 and the interior of the wall portion 34 of the burner tile 30. In the form illustrated in FIG. 1, the venturi aspirator tube 48 is comprised of two parts, i.e., a fuel gas and air inlet part 54 having converging sides and a discharge nozzle part 56 having diverging sides. The adjacent ends of the parts 54 and 56 are threadedly connected to the threaded portion of the fitting 46.

A fuel gas jet forming nozzle 58 is positioned within the housing 14 to jet fuel gas into and through the venturi tube 48. The jet forming nozzle 58 is connected to a conduit 60 which passes through the end 16 of the housing 14 and is connected to a fuel gas header 62 by means of a union 64. Also connected to the fuel gas header 62 by a unions 66 are four conduits 68 which pass through the end 16 of the housing 14, extend through the interior of the housing 14 and pass through the end 18 thereof. The conduits 68 extend through complimentary openings in the base portion 32 of the burner tile 30 and are connected to secondary fuel gas nozzles 70 positioned outside the wall portion 34 of the burner tile 30. The nozzles 70 are spaced around the periphery of the wall portion 34 and are each positioned adjacent to the intersection of a side 43 thereof with the surface 38 of the base portion 32. The nozzles 70 function to discharge secondary fuel gas adjacent to the external slanted sides 43 of the wall portion 34.

As will be described further hereinbelow, a portion of the fuel gas conducted to the header 62 designated as primary fuel gas because it is burned in a primary zone within the furnace is caused to flow by way of the conduit 60 to the jet forming nozzle 58. The remaining portion of the fuel gas, referred to herein as secondary fuel gas since it is burned in a secondary zone in the furnace, is distributed substantially equally between the conduits 68 and secondary fuel gas nozzles 70. In order to proportion the primary and secondary fuel gas and distribute the secondary fuel gas between the conduits 68 and nozzles 70, orifices can be included in the unions 64 and 66 as required.

In operation of the burner apparatus 10, fuel gas is introduced into the furnace to which the burner apparatus 10 is attached and burned therein at a flow rate which results in the desired heat release. A flow rate of air is introduced into the burner housing 14 by way of the connection 24 and flow regulating damper 26 such that at least a substantially stoichiometric mixture of fuel gas and air results in the furnace. That is, a flow rate of air is introduced into the furnace relative to the total flow rate of fuel gas introduced thereinto which results in a stoichiometric or greater than stoichiometric mixture. Preferably, the rate of air is in the range of from about the stoichiometric rate to about 25% greater than the stoichiometric rate.

As shown in the drawings by arrows formed of alternating dashes and dots, and referring particularly to FIG. 1, the air flows from the atmosphere into the interior of the housing 14 by way of the conduit 24 and damper 26 disposed therein. As shown by solid line arrows in the drawings, and still referring to FIG. 1, primary fuel gas is jetted from the jet forming nozzle 58 into the venturi aspirating tube 48 comprised of the inlet part 54 and discharge part 56. The jetting of the primary fuel gas causes air within the housing 14 to be drawn into the venturi aspirating tube 48 wherein the fuel gas and air are mixed. The resulting primary fuel gas—air mixture is discharged by way of the discharge nozzle 52 of the venturi aspirating tube 48 into the space defined by the central area 40 of the base portion 32 and the interior of the wall portion 34 of the burner tile 30. The primary fuel gas—air mixture begins to burn in the aforementioned space and is discharged therefrom into a primary burning zone within the furnace wherein the mixture is burned and flue gases having low $NO_x$ content are formed therefrom.

The remaining secondary portion of the fuel gas (shown by solid line arrows) is discharged by way of the nozzles 70 adjacent to the exterior slanted sides 43 of the wall portion 34. That is, the secondary fuel gas discharged by the nozzles 70 readily mixes with flue gases from the furnace (shown by dashed line arrows) and air remaining in the furnace. The discharge openings in the nozzles 70 are preferably configured to spread the secondary fuel gas over the exterior slanted sides 43 of the wall portion 34 which also enhances the mixing of the secondary fuel gas with flue gases and air. The mixture of secondary fuel gas and flue gases is discharged into a secondary burning zone surrounding the primary zone wherein it is burned and flue gases having low $NO_x$ content are formed therefrom.

Because the primary fuel gas is mixed with substantially all of the air, it contains excess air and burns at a relatively low temperature which reduces the amount of $NO_x$ produced in the flue gases. The secondary fuel gas is mixed with relatively cool flue gases prior to burning and it also burns at a relatively low temperature whereby low levels of $NO_x$ are produced in the flue gases therefrom.

The portion of the fuel gas which is used as primary fuel is generally in the range of from about 30% to about 90% by volume of the total fuel gas discharged by the burner apparatus and into the furnace. That is, the flow rate of primary fuel gas discharged into the furnace is from about 30% to about 90%, preferably about 75%, of the total fuel gas flow rate conducted to the burner apparatus 10, and the flow rate of the secondary fuel gas discharged into the furnace is from about 10% to about 70%, preferably about 25%, of the total fuel gas flow rate.

Figure 3:
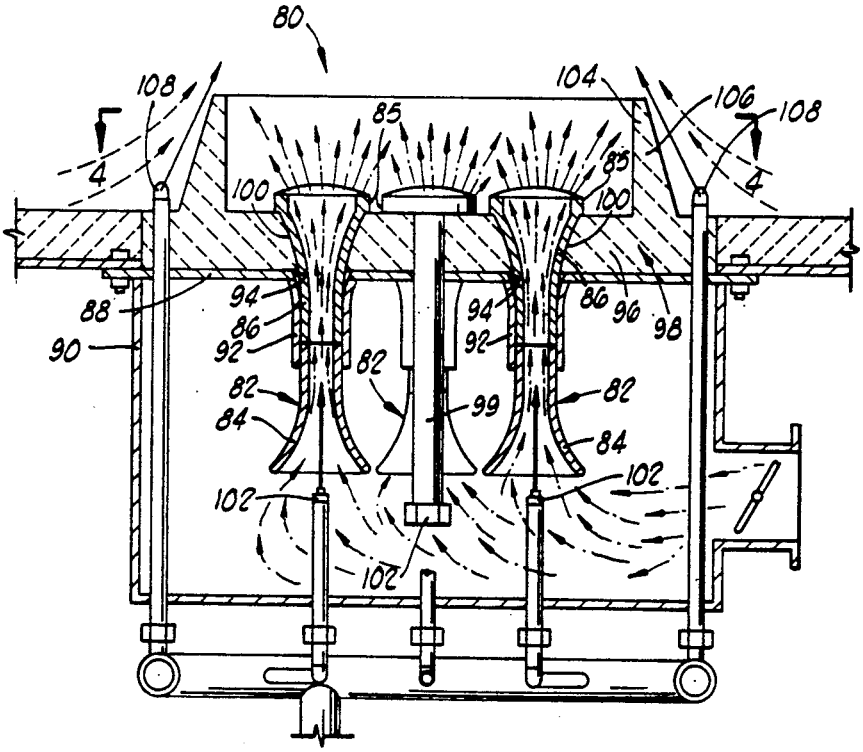
FIG. 3 is a side cross-sectional view of an alternate form of burner apparatus of the present invention.
Figure 4:
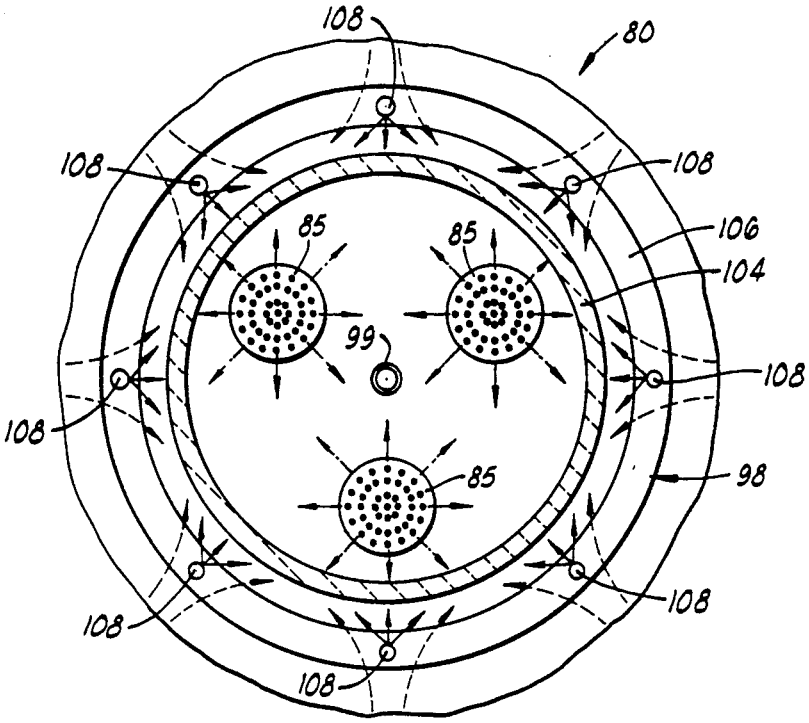
FIG. 4 is a cross-sectional view taken along line 4—4 of FIG. 3.

Referring now to FIGS. 3 and 4, an alternate form of the burner apparatus of the present invention is illustrated and generally designated by the numeral 80. The burner apparatus 80 is identical in structure and operation to the burner apparatus 10 described above except that instead of a single venturi aspirator tube 48, the burner apparatus 80 includes three venturi aspirator tubes 82. Each of the venturi aspirator tubes 82 is comprised of a converging inlet part 84 and a diverging discharge nozzle part 86. The interior end 88 of the housing 90 includes three threaded fittings 92 to which the parts 84 and 86 are threadedly connected attached over openings 94 therein, and the base portion 96 of a burner tile 98 includes complimentary openings 100 therein for receiving the parts 86. A primary fuel gas jet forming nozzle 102 is positioned to jet primary fuel gas into each of the venturi aspirator tubes 82. Also, the burner apparatus 80 (and the burner apparatus 10 described above) can optionally include a supplemental air pipe 99 which extends from within the housing 90 through the interior end 88 of the housing 90 and through the burner tile 98. A fitting 101 containing a changeable orifice for controlling the rate of air which flows through the pipe 99 can be connected to the inlet end of the pipe 99.

As described above in connection with the apparatus 10, the primary fuel gas—air mixtures discharged by the nozzles 85 of the parts 86 enter the space within the interior of the wall portion 104 of the burner tile 98 from where they are discharged to a primary burning zone within the furnace. Also, if the optional air pipe 99 is included, additional air enters the space within the wall portion 104 and mixes with the fuel gas—air mixtures discharged from the nozzles 52.

Secondary fuel gas is discharged adjacent to the exterior slanted sides 106 of the wall portion 104 by a plurality of secondary fuel gas nozzles 108. The secondary fuel gas mixes with flue gases in the furnace and burns in a secondary burning zone therein. The flue gases produced by the burner apparatus 80 are of low $NO_x$ content for the same reasons as those set forth above relating to the apparatus 10.

As will be understood by those skilled in the art, the burner apparatus 10 and 80 can also be utilized in forced draft applications. That is, instead of mixing the primary fuel gas with atmospheric air in one or more venturi aspirator tubes, the primary fuel gas can be mixed with pressurized air in a conventional forced draft mixing apparatus, and the resultant primary fuel gas—air mixture can be conducted directly to the discharge nozzle 52 of the apparatus 10 or discharge nozzles 85 of the apparatus 80.

Figure 5:
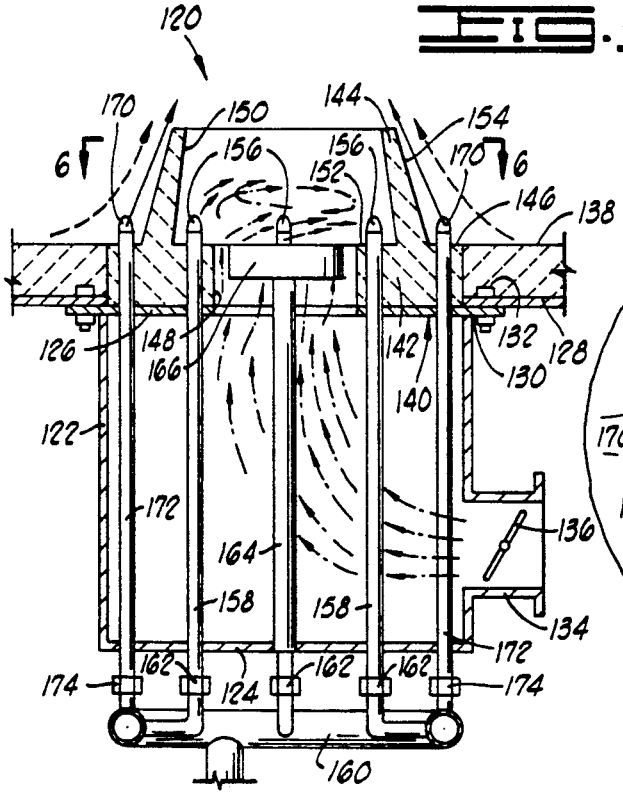
FIG. 5 is a side cross-sectional view of yet another form of burner apparatus of the present invention.
Figure 6:
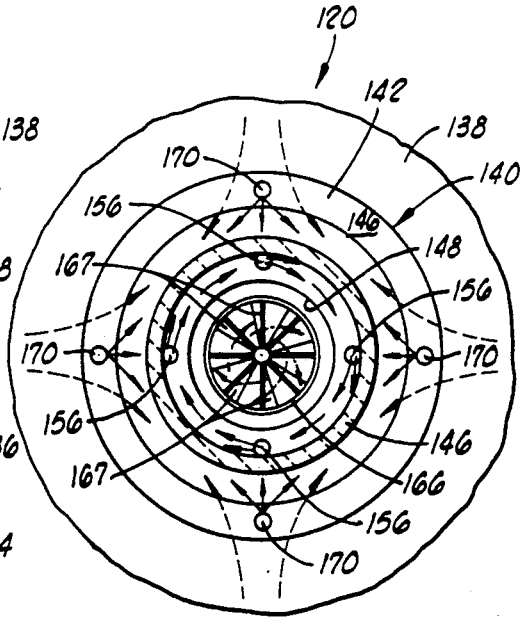
FIG. 6 is a cross-sectional view taken along line 6—6 of FIG. 5.

Referring now to FIGS. 5 and 6, yet another embodiment of the burner apparatus of the present invention is illustrated and generally designated by the numeral 120. The burner apparatus 120 is used in natural or forced draft applications, and like the burner apparatus 10 and 80 described above, produces flue gases having low $NO_x$ content. The burner apparatus 120 is comprised of a housing 122 having a closed exterior end 124 and an open interior end 126. The housing 122 is attached to a furnace wall 128 by means of a flange 130 attached to the housing 122 and a plurality of bolts 132 which extend through complimentary openings in the flange 130 and wall 128. A combustion air inlet connection 134 is attached to the housing 122, and a conventional air flow rate regulating damper 136 is connected to and disposed within the air inlet connection 134. The furnace wall 128 includes an internal layer of insulating material 138 attached thereto, and the open end 126 of the housing 122 includes a refractory burner tile 140 attached thereto.

The burner tile 140 is comprised of a substantially circular base portion 142 and a substantially circular wall portion 144. The external side of the base portion 142 is positioned adjacent the end 126 of the housing 122, and the internal side 146 of the base portion 142 faces the interior of the furnace to which the burner apparatus 120 is attached. The base portion 142 includes a central opening 148 therein, and the wall portion 144 extends into the furnace and surrounds the opening 148. The internal sides 150 of the wall portion 144 are spaced a distance from the periphery of the opening 148 whereby a ledge 152 is provided within the interior of the wall portion 144, and the external sides 154 of the wall portion 144 are slanted towards the opening 148. The internal sides 150 are also preferably slanted towards the opening 148.

Four primary fuel gas discharge nozzles 156 are positioned within the interior of the wall portion 144 of the burner tile 140 adjacent the interior sides 150 thereof and the ledge 152 therein. The nozzles 156 are connected to conduits 158 which pass through the base portion 142 of the burner tile 140 and through the ends 124 and 126 of the housing 122. The conduits 158 are connected to a pressurized fuel gas header 160 by unions 162. The apparatus 120 can also include a fixed blade swirler 166 positioned within the opening 148 by a support member 164 for causing all or a portion of the air flowing through the opening 148 to swirl.

Four secondary fuel gas nozzles 170 are spaced around the base portion 142 of the burner tile 140 outside the wall portion 144 thereof. The nozzles 170 are connected to conduits 172 which are connected to the fuel gas header 160 by unions 174, and are positioned to discharge secondary fuel gas adjacent to the external slanted sides 154 of the wall portion 144.

In operation of the burner apparatus 120, the air flows through the housing 122 (shown by arrows formed of alternating dashes and dots), through the passage 148 in the base portion 142 of the burner tile 140 and into the interior of the wall portion 144 thereof. As mentioned, the fixed blade swirler 166 (if used) causes all or part of the air to swirl as it flows into and through the interior of the wall portion 144. The nozzles 156 direct primary fuel gas in directions generally tangential to the interior sides 150 of the wall portion 144 whereby the primary fuel gas is swirled around the interior sides of the wall portion 144 above the ledge 152. The slanted interior sides 150 of the wall portion 144 force the swirling primary fuel gas into contact with the air flowing through the interior of the wall portion 144. As a result, the primary fuel gas mixes with the air flowing through the opening 148 and the resulting primary fuel gas—air mixture begins to burn and is discharged from the interior of the wall portion 144 to a primary burning zone within the furnace. The primary fuel gas—air mixture contains cooling excess air and when it is burned in the primary burning zone, flue gases of low $NO_x$ content are produced.

Secondary fuel gas is discharged from the nozzles 170 adjacent to the exterior slanted sides 154 of the wall portion 144 of the burner tile 140. As described above in connection with the burner apparatus 10 and 80, the secondary fuel gas readily mixes with flue gases (shown by the dashed line arrows) and air remaining in the furnace. The resulting secondary fuel gas—flue gases air mixture is burned in a secondary burning zone whereby additional flue gases of low $NO_x$ content are formed.

The rate of air introduced into the housing 122 and discharged by the burner 120 is preferably in the range of from about a stoichiometric rate to about 25% greater than such stoichiometric rate. The portion of fuel gas which is used as primary fuel is generally in the range of from about 10% to about 80% by volume of the total fuel gas discharged by the burner apparatus 120 into the furnace.

As mentioned, the swirler 166 which is comprised of a plurality of fixed blades 167 (FIG. 6) can optionally be used to cause air flowing into the interior of the wall portion 144 of the burner tile 140 to swirl whereby it more readily mixes with the swirling primary fuel gas therein. Other alternate apparatus for enhancing mixing can be used with or substituted for the swirler 166, e.g., a cylindrical baffle which annularizes the flow of air.

In order to further illustrate the low $NO_x$ formation burner apparatus and methods of the present invention, the following examples are given.

EXAMPLE I

A burner apparatus 10 designed for a heat release of 10,000,000 BTU/hour by burning natural gas having a caloric value of 1,000 BTU/SCF is fired into a furnace.

Pressurized fuel gas is supplied to the manifold 62 of the burner 10 at a pressure of about 30 PSIG and at a rate of 3,000 SCF/hour. A 75% by volume portion of the fuel gas (2250 SCF/hour) is used as primary fuel gas and is jetted into the venturi aspirator tube 48 by the nozzle 58 which results in air being drawn into the venturi aspirator tube 48 and mixing with the primary fuel gas. The remaining secondary portion of the fuel gas, i.e., 750 SCF/hour, is discharged into the furnace by the nozzles 70.

The rate of air introduced into the housing 14 is controlled by means of the damper 26 such that the rate of air drawn into the venturi aspirator tube 48 is a substantially stoichiometric rate relative to the total fuel gas rate discharged into the furnace.

The primary fuel gas—air mixture formed in the venturi aspirator tube 48 is discharged therefrom by the nozzle 52 positioned within the interior of the wall portion 34 of the burner tile 30 into a primary burning zone in the furnace wherein it is burned.

The fuel gas discharged from the secondary fuel gas nozzles 64 adjacent to the wall portion 34 mixes with relatively cool flue gases and air remaining from the primary burning zone. The resulting mixture is burned in a secondary burning zone generally adjacent to and surrounding the primary burning zone in the furnace space.

Because of the dilution of the primary fuel gas with excess air and the dilution of the secondary fuel gas with flue gases, relatively low temperature burning results whereby the flue gases formed have a low $NO_x$ content. That is, the flue gases withdrawn from the furnace have a $NO_x$ content of less than about 25 ppm.

EXAMPLE II

A burner apparatus 120 designed for a heat release of 10,000,000 BTU/hour by burning natural gas having a caloric value of 1,000 BTU/SCF is fired into a furnace space.

Pressurized fuel-gas is supplied to the burner 150 at a pressure of about 30 PSIG and at a rate of 10,000 SCF/hour. A 15% by volume portion of the fuel gas (1500 SCF/hour) is utilized as the primary fuel gas which is jetted into the space above the ledge 152 and adjacent the interior sides 150 of the wall portion 144 of the burner tile 140. The remaining secondary portion of the fuel gas, i.e., 8500 SCF/hour is discharged adjacent to the exterior slanted sides 154 of the wall portion 140 by the secondary nozzles 168.

The rate of air introduced into the housing 122 is controlled such that the rate of air discharged into the furnace is at least a substantially stoichiometric rate relative to the total fuel gas rate discharged therein.

The air flows through the opening 148 of the burner tile 140 into the mixing zone defined by the wall portion 144 of the burner tile 140 and mixes with the primary fuel gas discharged therein by the nozzles 156 The resulting primary fuel gas—air mixture begins burning and is discharged into and burned in a primary burning zone in the furnace space.

The secondary fuel gas discharged from the secondary fuel gas nozzles 170 mixes with flue gases from the furnace space and with air remaining therein and is burned in a secondary burning zone generally adjacent to and surrounding the primary burning zone in the furnace.

Because of the dilution of the primary fuel gas with excess air and the secondary fuel gas with flue gases, relatively low temperature burning results whereby the flue gases formed in and withdrawn from the furnace have a $NO_x$ content of less than about 25 ppm.

Thus, the present invention is well adapted to carry out the objects and attain the ends and advantages mentioned as those which are inherent therein. While numerous changes in the construction and arrangement of parts may be made by those skilled in the art, such changes are encompassed within the spirit of this invention as defined by the appended claims.

What is claimed is:

1. An improved burner apparatus for discharging a mixture of fuel gas and air into a furnace wherein said mixture is burned and flue gases having low $NO_x$ content are formed therefrom comprising:

a refractory burner tile attached to said furnace having a base portion and a wall portion, the wall portion extending into said furnace, surrounding a central area of said base portion and having exterior sides which slant towards the central area of said base portion;

means connected to said burner tile for mixing a portion of said fuel gas with said air and discharging the resulting primary fuel gas-air mixture into a primary burning zone in said furnace from within the space defined by the central area of said base portion and the interior of said wall portion of said burner tile; and at least one secondary fuel gas nozzle means positioned outside said wall portion of said refractory burner tile adjacent the intersection of an external slanted side of said wall portion with the surface of said base portion for discharging the remaining portion of said fuel gas adjacent to an external slanted side of said wall portion and spreading said fuel gas over said slanted side whereby said fuel gas mixes with flue gases in said furnace and burns in a secondary burning zone therein.

2. The burner apparatus of claim 1 wherein said means for mixing primary fuel gas with said air and discharging the resulting mixture into said furnace comprise:

said burner tile including at least one passage formed in said base portion thereof extending from the exterior of said burner tile into the space defined by the central area of said base portion and the interior of said wall portion;

venturi aspirator means having a fuel gas and air inlet at one end and a fuel gas—air mixture discharge nozzle at the other end, said venturi aspirator means being disposed within said passage in said base portion of said burner tile with said discharge nozzle thereof positioned within said space defined by the central area of said base portion and said wall portion of said burner tile and the fuel gas and air inlet thereof positioned exteriorly of said burner tile; and a fuel gas jet forming nozzle adapted to be connected to a source of fuel gas positioned to jet primary fuel gas into said venturi means by way of the inlet end thereof whereby air is drawn into said venturi means and mixes with said primary fuel gas.

3. The burner apparatus of claim 2 which further comprises:

a housing attached to the exterior of said burner tile and enclosing said venturi aspirator means and said fuel gas jet forming nozzle; and means for introducing a regulated rate of air into said housing attached thereto.

4. The burner apparatus of claim 2 or 3 wherein said base portion of said burner tile includes two or more of said passages formed therein with venturi aspirator means disposed in each passage and a fuel gas jet forming nozzle positioned to jet primary fuel gas into each venturi aspirator means.

5. The burner apparatus of claim 3 wherein said base portion and said wall portion of said burner tile are substantially circular.

6. The burner apparatus of claim 1 wherein said apparatus includes a plurality of said secondary fuel gas nozzle means.

7. The burner apparatus of claim 1 wherein said means for mixing primary fuel gas with said air and discharging the resulting mixture into said furnace comprise:

said burner tile including at least one passage formed in said base portion thereof extending from the exterior of said burner tile into the space defined by the central area of said base portion and the interior of said wall portion, said opening being smaller than said central area whereby a ledge is formed around said opening within the interior of said wall portion;

means for discharging said air through said opening attached to said burner tile; and at least one primary fuel gas nozzle means positioned to discharge primary fuel gas adjacent to the interior sides of said wall portion and adjacent to said ledge whereby said primary fuel gas is swirled within said wall portion and mixed with said air.

8. The burner apparatus of claim 7 wherein the interior sides of said wall portion of said burner tile are slanted towards said opening.

9. The burner apparatus of claim 7 wherein said means for discharging said air through said opening in said burner tile comprise:

a housing attached to the exterior of said burner tile; and means for introducing a regulated rate of air into said housing attached thereto.

10. The burner apparatus of claim 7 or 9 wherein said apparatus includes a plurality of said primary fuel gas nozzle means.

11. The burner apparatus of claim 10 wherein said base portion and said wall portion of said burner tile are substantially circular.

12. The burner apparatus of claim 11 wherein said apparatus includes a plurality of said secondary fuel gas nozzle means.

13. A method of discharging a mixture of fuel gas and air into a furnace wherein said mixture is burned and flue gases having a low $NO_x$ content are formed therefrom comprising the steps of:

(a) mixing a portion of said fuel gas with said air to form a primary fuel gas—air mixture;

(b) discharging said primary fuel gas—air mixture into a primary burning zone in said furnace from at least one location surrounded by a wall which extends into said furnace and has exterior sides which are slanted towards said location; and (c) discharging the remaining portion of said fuel gas from at least one location outside of said wall at the bottom of and adjacent to an exterior slanted side thereof whereby said fuel gas is spread over said slanted side and said fuel gas mixes with flue gases and air in said furnace space and is burned in a secondary burning zone therein.

14. The method of claim 13 wherein said mixture of fuel gas and air discharged into said furnace is a substantially stoichiometric mixture.

15. The method of claim 13 wherein said portion of said fuel gas used to form said primary fuel gas—air mixture in accordance with step (a) is in the range of from about 10% to about 90% by volume of the total fuel gas discharged into said furnace space.

16. The method of claim 13 wherein said primary fuel gas—air mixture is formed in accordance with step (a) by jetting said primary fuel gas into one end of a venturi aspirator tube having a discharge nozzle at the other end positioned at said location whereby said air is drawn into said venturi aspirator tube and mixed with said primary fuel therein.

17. The method of claim 16 wherein said primary fuel gas—air mixture is formed by jetting said primary fuel into two or more of said venturi aspirator tubes.

18. The method of claim 16 or 17 wherein said remaining portion of said fuel gas is discharged adjacent to the exterior slanted sides of said wall portion from a plurality of locations outside of said wall portion.

19. The method of claim 13 wherein said primary fuel gas—air mixture is formed by discharging said air into said furnace at said location surrounded by said wall portion and discharging said primary fuel gas from at least one fuel gas nozzle adjacent to the interior sides of said wall portion whereby said fuel gas is swirled therein and mixed with said air.

20. The method of claim 19 wherein said primary fuel gas is discharged adjacent to the interior sides of said wall portion from a plurality of fuel gas nozzles.

21. The method of claim 19 or 20 wherein said remaining portion of said fuel gas is discharged adjacent to the slanted exterior sides of said wall portion from a plurality of locations outside of said wall portion.

* * * * *